US005218333A

United States Patent [19]

Kobayashi

[11] Patent Number: 5,218,333

[45] Date of Patent: Jun. 8, 1993

[54] MAGNETIC FIELD GENERATING DEVICE FOR USE WITH ESR DEVICE

[75] Inventor: Takashi Kobayashi, Osaka, Japan

[73] Assignee: Sumitomo Special Metal Co., Ltd., Osaka, Japan

[21] Appl. No.: 415,587

[22] Filed: Oct. 2, 1989

[51] Int. Cl.[5] ..... H01F 1/00

[52] U.S. Cl. ..... 335/296; 335/298; 335/302; 335/306

[58] Field of Search ..... 338/32 R, 32 S, 32 H; 324/316, 317, 318; 335/298, 306, 299, 296, 182, 287, 217, 301, 202, 302, 131-133

[56] References Cited

U.S. PATENT DOCUMENTS 3,187,237 6/1965 Craig et al. ..... 335/306
3,223,897 12/1965 Sullivan ..... 335/182
3,900,814 8/1975 Masuda ..... 338/32 R
4,093,912 6/1978 Double et al. ..... 335/287
4,636,756 1/1987 Ito et al. ..... 335/202
4,717,979 1/1988 Washisu ..... 338/32 R X
5,097,240 3/1992 Nakanishi et al. ..... 335/296

*Primary Examiner*—Marvin M. Lateef
*Attorney, Agent, or Firm*—Watson, Cole, Grindle & Watson

[57] ABSTRACT

A magnetic field generating device for use with an ESR (electronic spin resonance) device essentially comprises a pair of stationary yokes and a pair of permanent magnets respectively attached to the yokes in opposite and spaced apart relationship with each other so that a magnetic field is generated in the space between the permanent magnets. A movable yoke is attached to at least one of the pair of stationary yokes so that the magnetic resistance of the magnetic path formed by the permanent magnets, stationary yokes and movable yoke is varied without changing the size of the space between the permanent magnets thereby generating a continuously changing magnetic field between the permanent magnets.

8 Claims, 2 Drawing Sheets

MAGNETIC FIELD GENERATING DEVICE FOR USE WITH ESR DEVICE

BACKGROUND OF THE INVENTION

1. Field of the Invention

The present invention relates to a magnetic field generating device used for an electron spin resonance device (hereinafter referred to as the "ESR Device") and more particularly to such type of magnetic field generating device that is capable of continuously varying a magnetic field between the magnetic poles of permanent magnets arranged opposite to each other leaving a desired space therebetween while the magnetic field is made to keep a high uniformity.

The ESR device is an instrument which is being made use of in the fields of archaeology and earth science and which is capable of measuring the ages of archaeological remains, geology, minerals and fossil remains.

That is, the ESR device can detect unpaired electrons due to natural radiation damages of the above-mentioned test objects and measure the ages of the objects from the detected values.

For the magnetic field generating device forming an essential part of the ESR device, it is necessary to form a magnetic field of about 3400 gauss in the space in which a test object is arranged and to continuously change the intensity of the magnetic field within the range of ± about 100 gauss.

2. Description of the Prior Art

As a magnetic field generating source for a magnetic field generating device used with the ESR device, there has hitherto been known a structure comprising electromagnets or a combination of an electromagnet and a permanent magnet.

It is easy to continuously change a magnetic field in a desired space by continuously varying a voltage applied on the electromagnets, but the intensity of the magnetic field is hardly adjusted in a stabilized state. Further, due to the necessity of providing an exciting power source, the entire device becomes inevitably large-sized and expensive.

Further, there has been proposed a structure using only permanent magnets as a magnetic field generating source so that the magnetic field intensity is changed by changing the opposing distance (length of the space) between the permanent magnets.

However, this structure has also had the disadvantage that when the distance between the opposing permanent magnets is changed, the uniformity of the magnetic field is impaired due to various causes including the deviation of the axis of one of the opposing permanent magnets from that of the other.

Usually, the uniformity of the magnetic field required of such magnetic field generating device is less than 1% and especially when an accurate measurement is required, a uniformity of less than 0.01% is considered necessary.

SUMMARY OF THE INVENTION

An object of the present invention is to provide a small-sized and inexpensive magnetic field generating device for use with a ESR device by enabling the magnetic field intensity to be continuously changed in a stabilized state while the magnetic field is made to keep a high and favorable uniformity.

The present invention has achieved the above object by the provision of a pair of opposing permanent magnets serving as a magnetic field generating source, stationary yokes for forming a magnetic path and a movable yoke attached to one of the stationary yokes so as to change the magnetic resistance of the magnetic path without changing the size of the space between the opposing permanent magnets.

That is, the magnetic field generating device of the present invention is characterized in that in an arrangement in which a pair of permanent magnets are respectively attached to the opposing surfaces of a pair of stationary yokes arranged in spaced apart relationship with each other so that a continuously varying magnetic field is generated in the space between the magnets. A movable yoke for continuously changing the distance between the opposing surfaces of the stationary yokes is attached to at least one of the stationary yokes whereby the magnetic resistance of a magnetic path formed by the permanent magnets, stationary yokes and the movable yoke is continuously varied.

DESCRIPTION OF THE PREFERRED EMBODIMENTS

In the case of the present invention, the shape of the stationary yokes to which permanent magnets are attached is optional. For example, each yoke may be in the form of a square plate or the like depending on the shape of the each of permanent magnets used, magnetic characteristics etc.

For the permanent magnets serving as a magnetic field generating source, it is desired to select a known material and shape depending on the required magnetic field intensity and the size of the device. For example, each permanent magnet may be made of a rare earth group or ferritic material.

Further, there may be attached a magnetic pole piece to each of the opposing surfaces of the pair of permanent magnets so as to improve the uniformity of the magnetic field as necessary.

The movable yoke which is adapted to continuously change the magnetic resistance in the magnetic path may well be attached to at least one of the stationary yokes.

In addition, as a method for continuously changing the distance between the opposing surfaces of the movable yoke and one of the stationary yokes which is not attached with the movable yoke, the movable yoke may be formed of a bolt screwed into one of the stationary yokes so that the bolt is moved forward and rearward manually or automatically. Any other structure and shape may be freely selected only if it could continuously vary the magnetic resistance of the magnetic path. Further, any known moving means such as a rack-pinion, hydraulic piston and slide mechanism may be employed.

Where the movable yoke is attached to only one of the stationary yokes, an additional stationary yoke may be attached to the other stationary yoke which is not attached with the movable yoke, as shown in the instant embodiment, so that the magnetic field is more efficiently adjusted.

Figure 1:
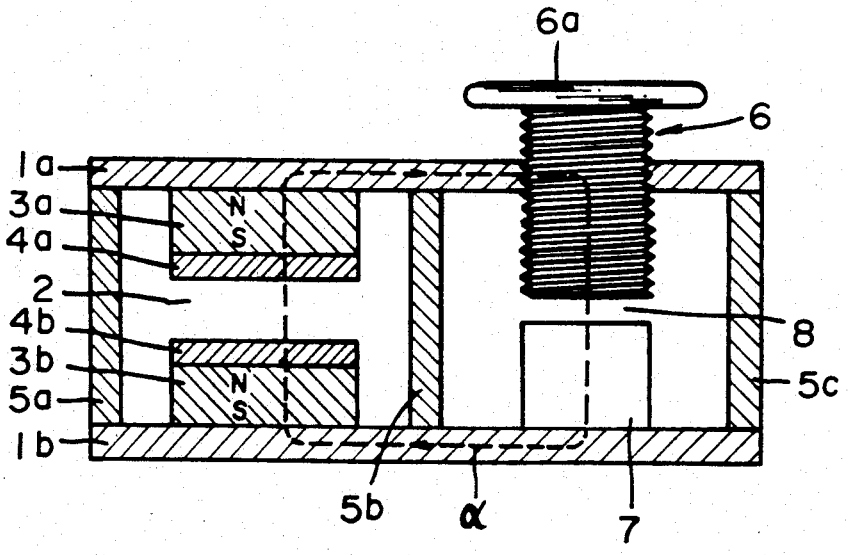
FIG. 1 is a vertical sectional view of one embodiment of a magnetic field generating device for use with an ESR device according to the present invention.

Referring to FIG. 1, a pair of platelike stationary yokes 1*a* and 1*b* are arranged opposite to each other through supports 5*a*, 5*b* and 5*c* made of a nonmagnetic material so as to form a required space 2 between a pair of disk-like permanent magnets 3*a* and 3*b*.

That is, the disk-like permanent magnets 3*a* and 3*b* are attached to the opposing surfaces of the platelike stationary yokes 1*a* and 1*b* with their magnetic poles reversed and magnetic pole pieces 4*a* and 4*b* are fixed to the opposing surfaces of the magnets leaving a desired space therebetween.

To the lower surface of one of the stationary yokes, i.e., the yoke 1*a*, there is attached a movable yoke 6.

The movable yoke 6 is in the form of a screwed bolt which is screw-threaded into a hole of the yoke 1*a*.

When a handle 6*a* at the top of the movable yoke 6 is rotated, the movable yoke 6 is moved continuously in the vertical direction.

Further, to the upper surface of the other stationary yoke 1*b* there is attached an additional stationary yoke 7 in opposite relationship with the movable yoke 6 leaving a gap 8 therebetween.

With the above-described arrangement, there is formed in the magnetic field generating device a magnetic path $\alpha$ shown by a broken line in FIG. 1 and when the movable yoke 6 is moved forward and rearward, the opposing distance between the movable yoke 6 and the additional stationary yoke 7, that is, the gap 8 changes continuously so that the intensity of the magnetic field formed in the space 2 between the magnetic pole pieces 4*a* and 4*b* is continuously changed.

That is, when the distance between the movable yoke 6 and the stationary yoke 7 is made large, the intensity of the magnetic field in the space 2 becomes weak and vice versa.

Figure 2:
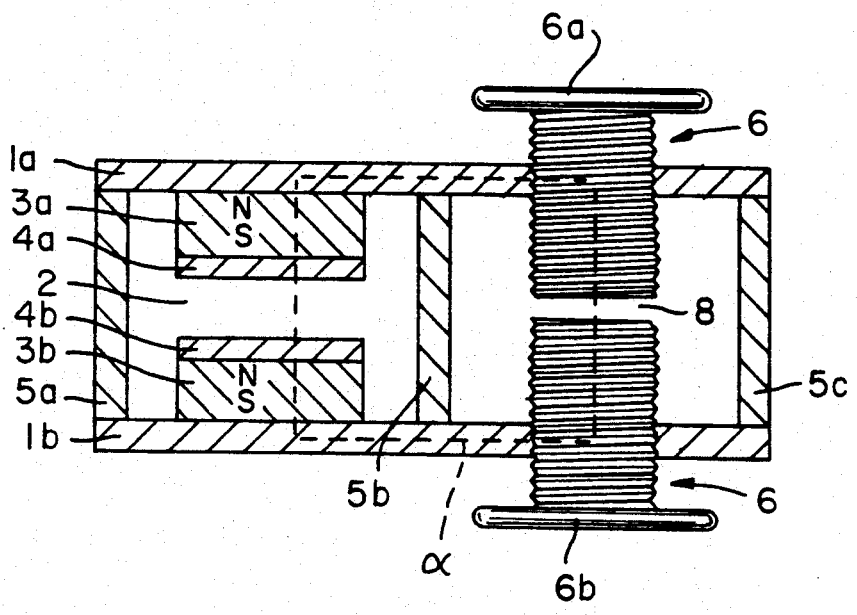
FIGS. 2 and 3 are respective vertical sectional views showing respective modified embodiments of a magnetic field generating device for use with an ESR device of the present invention.

FIG. 2 shows a modification of the magnetic field generating device wherein two movable yokes 6, 6 are provided such that each one of them is attached to each of a pair of plate-like stationary yokes 1*a* and 1*b*. Each of the movable yokes 6, 6 can be continuously moved independently in the vertical direction by rotating a handle 6*a* or 6*b*. With the arrangement as shown in FIG. 2, the opposing distance between the movable yokes 6, 6 changes continuously so that the intensity of the magnetic field formed in the space 2 is continuously changed as in the arrangement shown in FIG. 1. In such a case it is not always necessary to move the movable yokes 6, 6 at the same time. The movement of either one of the movable yokes can fulfill the object of the present invention.

As described above, it is possible with the present invention to obtain a stabilized uniform magnetic field intensity since the size of the space between the opposing magnetic poles in which a test object is arranged is kept constant.

Further, it is possible with the invention to continuously change the magnetic field intensity within the desired space by changing the magnetic resistance of the magnetic path through the simple operation of moving the movable yoke. In addition, it is possible to select a desired magnetic field intensity within the moving range of the movable yoke.

In addition, since the magnetic field generating device of the present invention does not require an electromagnetic coil and an exciting power source therefor, the magnetic field intensity does not become stable and the device can be miniaturized thereby contributing to the reduction of cost.

Moreover, where the amount of variation of the magnetic field intensity is required to be small, such requirement may be satisfied by, for example, making at least one of the yoke supports (5*a*, 5*b* and 5*c*) of FIG. 1 of a magnetic material so that the amount of magnetic flux flowing through the magnetic path on the yoke side is minimized.

Figure 3:
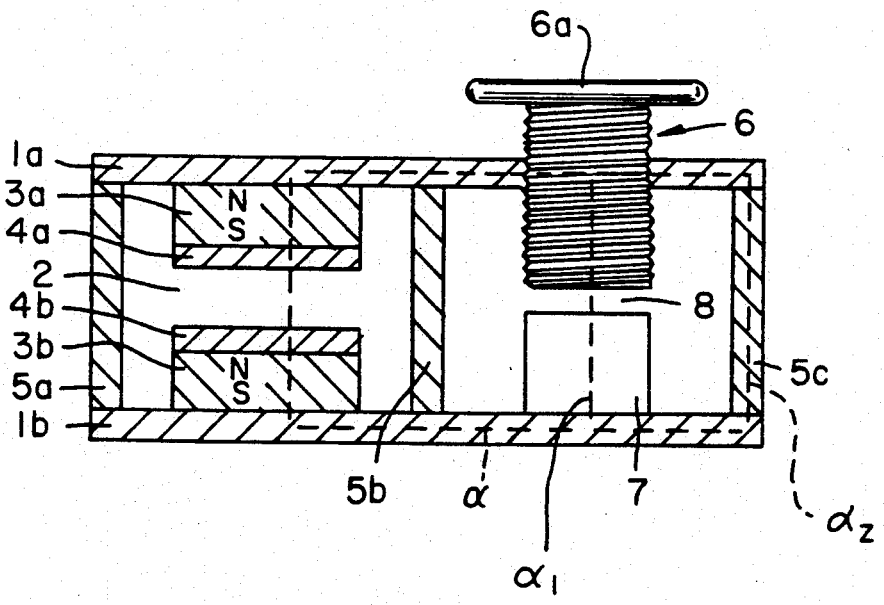

That is, referring to FIG. 3, if only one support 5*c* among the supports 5*a*, 5*b* and 5*c* is composed of a magnetic material, a magnetic path $\alpha_1$ passing through the movable yoke 6 and the stationary yoke 7 and a magnetic path $\alpha_2$ passing through the support 5*c* of the magnetic material will be formed in parallel with each other between a pair of the plate-like stationary yokes 1*a* and 1*b*. In consideration of that the magnetic flux generated from a pair of the permanent magnets 3*a* and 3*b* is constant and that according to the arrangement of FIG. 3, a portion of the magnetic flux flows through the support 5*c*, the amount of the magnetic flux flowing through the movable yoke 6 and the stationary yoke 7 is inevitably minimized.

What is claimed is:

1. A magnetic field-generating device for an ESR system, comprising:

a magnetic field-generating portion and a magnetic resistance changing portion, said magnetic field-generating portion comprising permanent magnets fixed respectively to the inner surfaces of a pair of plate-like yokes arranged in opposing and spaced apart relationship with each other;

magnetic pole pieces fixed respectively to the opposing surfaces of said permanent magnets to form an air gap between said magnetic pole pieces;

said magnetic resistance changing portion being aligned with said magnetic field-generating portion and comprising a movable yoke on either one of said paired plate-like yokes and a stationary yoke arranged on another of said paired plate-like yokes to be opposite to said movable yoke; and an opposing distance between said movable yoke and said stationary yoke is changed to continuously change the magnetic resistance of the magnetic path formed by said permanent magnets, plate-like yokes, movable yoke and stationary yoke, thereby continuously changing the magnetic field intensity in said air gap of said magnetic field-generating portion.

2. A magnetic field-generating device for an ESR system, comprising:

a magnetic field-generating portion and a magnetic resistance changing portion, said magnetic field-generating portion comprising permanent magnets fixed respectively to the inner surfaces of a pair of plate-like yokes arranged in opposing and spaced apart relationship with each other;

magnetic pole pieces fixed respectively to the opposing surfaces of said permanent magnets to form an air gap between said magnetic pole pieces; and said magnetic resistance changing portion being aligned with said magnetic field-generating portion and comprising movable yokes, each being disposed on on each one of said paired plate-like yokes to be movable to change the opposing distance between said movable yokes, thereby continuously changing the magnetic resistance of the magnetic path formed by said permanent magnets, plate-like yokes and movable yokes to continuously change the magnetic field intensity in said air gap of said magnetic field-generating portion.

3. A magnetic field-generating device according to claim 2, wherein said movable yokes comprise screw-threaded yokes, each of which pass through one of said stationary yokes to move forward and rearward along the axis of said screw-threaded yokes.

4. A magnetic field-generating device according to claim 2, wherein each of said pair of permanent magnets is made of a material belonging to the rare earth group.

5. A magnetic field-generating device according to claim 2, wherein said pair of stationary yokes are magnetically connected with magnet support members, respectively, so that a short-circuit magnetic path is formed.

6. A magnetic field-generating device according to claim 1, wherein said movable yoke comprises a screw-threaded yoke, passing through one of said stationary yokes to move forward and rearward along the axis of said screw-threaded yoke.

7. A magnetic field-generating device according to claim 1, wherein each of said permanent magnets is made of a material belonging to the rare earth group.

8. A magnetic field-generating device according to claim 1, wherein said pair of plate-like yokes are magnetically connected with magnet support members, respectively, so that a short-circuit magnetic path is formed.

* * * * *